US007707956B2

(12) United States Patent
Moore

(10) Patent No.: US 7,707,956 B2
(45) Date of Patent: May 4, 2010

(54) WAKE CONTROL MECHANISM

(75) Inventor: Steven Clay Moore, 8211 Long Canyon Dr., Austin, TX (US) 78732

(73) Assignee: Steven Clay Moore, Austin, TX (US)

( * ) Notice: Subject to any disclaimer, the term of this patent is extended or adjusted under 35 U.S.C. 154(b) by 1075 days.

(21) Appl. No.: 11/081,996

(22) Filed: Mar. 16, 2005

(65) Prior Publication Data

US 2005/0155540 A1 Jul. 21, 2005

Related U.S. Application Data

(63) Continuation of application No. 10/734,888, filed on Dec. 15, 2003, now Pat. No. 6,941,884.

(51) Int. Cl.
*B63B 1/22* (2006.01)

(52) U.S. Cl. ..... 114/284

(58) Field of Classification Search ..... 114/282, 114/284–287, 248

See application file for complete search history.

(56) References Cited

U.S. PATENT DOCUMENTS

| | | | | |
|---|---|---|---|---|
| 3,391,667 | A | 7/1968 | Lo Bue | |
| 3,399,643 | A | 9/1968 | Bennett | |
| 3,456,610 | A * | 7/1969 | Beals | 114/285 |
| 3,760,758 | A | 9/1973 | Banner | |
| 4,261,278 | A | 4/1981 | Gaudin | |
| 4,673,358 | A * | 6/1987 | Iwai et al. | 440/61 R |
| 4,854,259 | A | 8/1989 | Cluett | |
| 4,896,622 | A | 1/1990 | Thomas | |
| 4,967,682 | A | 11/1990 | O'Donnell | |
| 5,231,950 | A * | 8/1993 | Poulos | 114/274 |
| 5,263,432 | A | 11/1993 | Davis | |
| 5,315,951 | A | 5/1994 | Finkl | |
| 5,474,013 | A * | 12/1995 | Wittmaier | 114/286 |
| 5,549,071 | A | 8/1996 | Pigeon et al. | |
| 5,787,835 | A | 8/1998 | Remnant | |
| 5,860,384 | A | 1/1999 | Castillo | |
| 6,012,408 | A | 1/2000 | Castillo | |
| 6,105,527 | A | 8/2000 | Lochtefeld et al. | |
| 6,234,099 | B1 | 5/2001 | Jessen et al. | |
| 6,505,572 | B1 | 1/2003 | Seipel et al. | |
| 6,941,884 | B2 * | 9/2005 | Moore | 114/284 |

* cited by examiner

*Primary Examiner*—S. Joseph Morano
(74) *Attorney, Agent, or Firm*—Jeffrey S. Schubert; Schubert Osterrieder & Nickelson PLLC

(57) ABSTRACT

The present invention is a wake control mechanism for watercrafts comprising flat or upwardly curved wake control plate (s) which is/are connected to the stern in a variety of ways, either fixed or adjustable, such that the water passing beneath and/or beside the transom is scooped upward by the plate(s) and the watercraft is therefore pushed deeper into the water causing a larger wake. Additionally the plate(s) may have walls so that the scooped water is held above water level thus adding weight and further increasing wake size. Adjustments to the plate(s) position may be used to control the shape as well as the size of the wake.

5 Claims, 15 Drawing Sheets

WAKE CONTROL MECHANISM

CROSS-REFERENCE TO RELATED APPLICATION

Pursuant to 35 USC §120, this continuation application claims priority to and benefit of application Ser. No. 10/734,888, now U.S. Pat. No. 6,941,884, filed Dec. 15, 2003, on behalf of inventor Steven Clay Moore, entitled "Wake Control Mechanism".

FIELD OF INVENTION

The invention relates to a plate, typically behind a boat's transom to increase wake size, and/or modify wake shape.

BACKGROUND

Because wakeboarders like big wakes, boats built for wakeboarding usually now have water tanks, called bladders installed near the back of the boat to increase boat weight or "displacement" and thus increase wake size. Patents cover various bladder configurations. One patent covers a totally different method of modifying a boat wake by placing a flat plate (called a "trim tab') at the bottom-center of the transom. This method can change the shape of the wake, but it is not intended or effective for increasing wake size, because trim tabs raise the back or "stern" of the boat and thus reduce wake size. Before I/O boat motor drives included automatic tilt controls, "trim tabs", as shown in FIG. 1, were often installed on the bottom outside edges of the transom, to adjust not only the "trim" or bow/stern angle but also the list or port/starboard tilt. Most trim tabs are hydraulically controlled so that the driver can adjust the tilt of the boat while underway with a toggle switch. At slower speeds, when the bow tends to ride too high, the tabs are lowered, thus deflecting the water leaving the back of the boat downward and so providing lift to the back of the boat and lowering bow or "trim." If the boat is listing to one side, the trim tab on that side can be adjusted lower until there is no more sideways tilt. (Control mechanisms, typically hydraulic, for adjusting trim tabs have been in use for over 50 years and are not a part of this invention).

BRIEF SUMMARY OF THE INVENTION

The present invention achieves the same lowering of the boat rear that is achieved by a bladder, but without the added weight. The invention accomplishes this with one or more wake control plates, hereafter called plates, which look similar to normal trim tabs, but they have the opposite effect of trim tabs used so far, because: 1) the plates which are the subject of this patent are mounted so their front edge can be below the top surface of the flow of water beneath the hull of the boat versus normal trim tabs which are flush with the bottom of the hull, and 2) the plates are tilted up (back end higher than front edge) instead of down (back lower than front edge) so that the water can be scooped up instead of pushed down. This has the effect of forcing the back of the boat deeper into the water, just as added weight does, instead of lifting the stem as a normal trim tab does. The main advantages are: relatively little weight is added to the boat; more rapid adjustability; greater control of wake size; the plates can be adjusted to create different wake shapes compared to bladders which merely increase wake size; and the plates have dual use because they can be positioned so as to act like traditional trim tabs thus eliminating the need for normal trim tabs. No other inventions or designs found in patent searches describe plates or anything else designed to have negative lift by a water-scooping action.

The plates may be any size and may be connected to the stern and adjusted to various positions in a variety of ways, so that the front edge of the wake control plate(s) can be submersed in the water flowing past the boat, under the hull, behind the stern and/or to the sides of the stem, at an angle which provides a scooping action . . . the opposite of the lifting action of normal trim tabs. Additionally the plates may have walls allowing the water scooped up by the plates to accumulate above water level, thus increasing wake size by adding weight. It is the water scooping effect which is the object of this invention, regardless of what portion of the plates are in front, beside or behind the stern.

BRIEF DESCRIPTION OF THE DRAWINGS

Items in the drawings are labeled as follows:

"B" is a boat or watercraft;

"T" is the transom (the back face of the boat);

"P" is the plate or wake control mechanism;

"A1", "A2", "A3" are arms whose length can be adjusted;

"JJ" is a joint which swivels on one axis of rotation;

"J" is a joint which swivels on one axis of rotation and which can twist about the orthogonal axis up to approximately 20 degrees;

"CL" is a control lever in the hydraulic system to activate adjustable arms;

"V" is a vale in the hydraulic control system;

"HP" is the hydraulic pump in the hydraulic control system; and elements whose label is predicated with an "S" are screw, clip, pin or other mechanical attachment points, that also are "JJ" joints.

Figure 1:
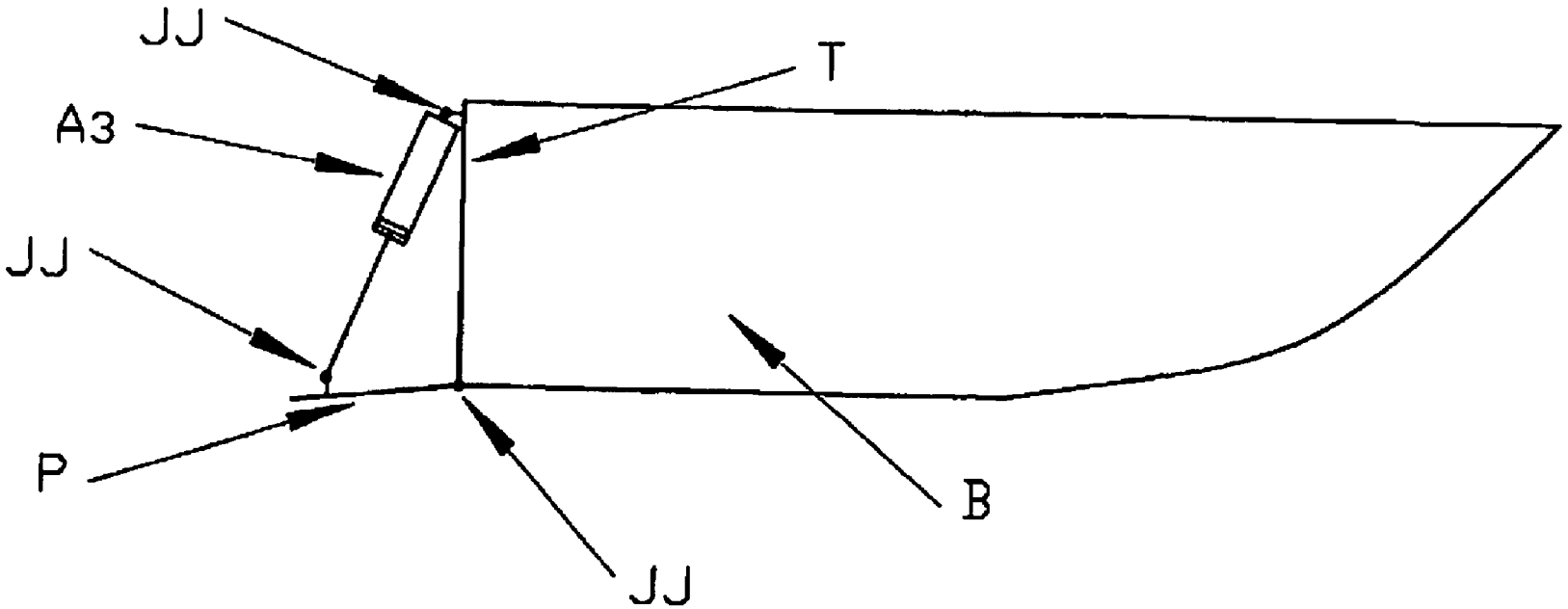

FIG. 1 a side view of the prior art, is a boat equipped with trim tabs that are hinged at the front edge. The front edge is thus fixed to remain flush with the hull and the front edge cannot extend below the bottom of the boat.

Figure 2A:
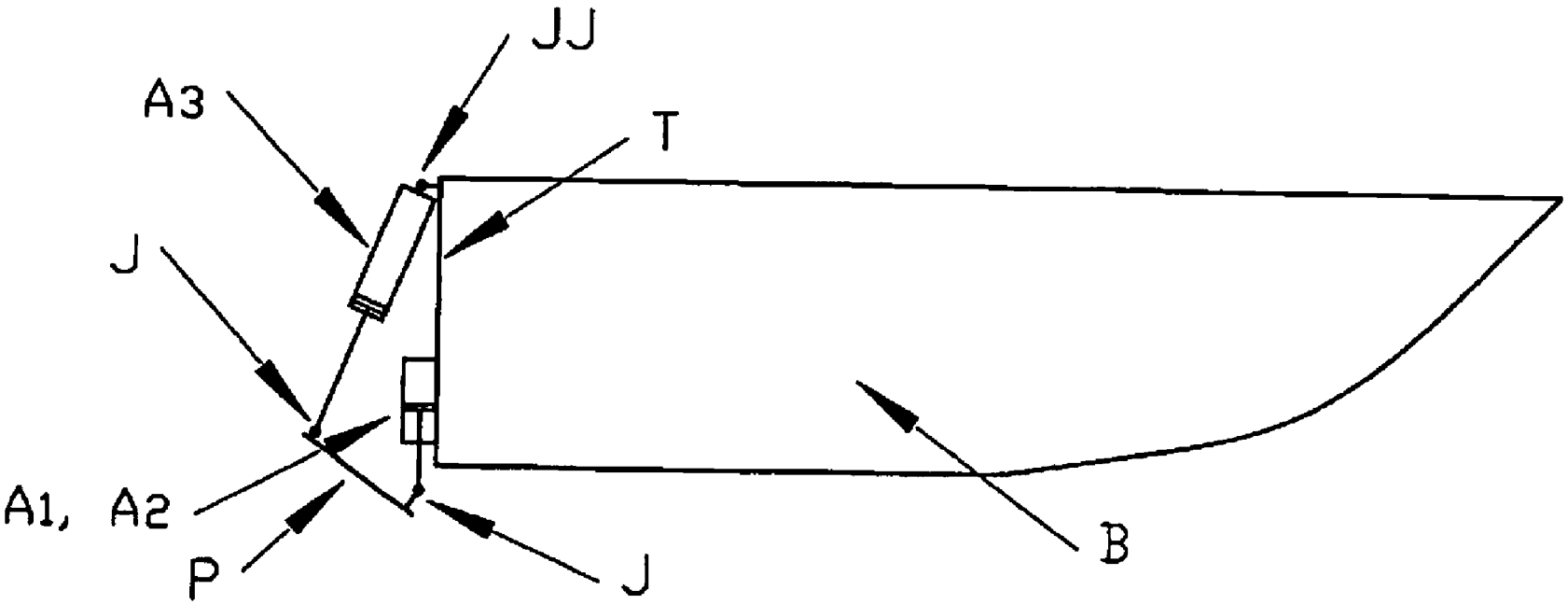

FIG. 2A the preferred embodiment, is a side view of a watercraft with a flat wake control plate connected to the stern by three length adjustable arms. The two front arms labeled "A1" and "A2" are solidly attached to the transom so that the front of the plate can only move horizontally as the arms lengthen or shorten. Arms "A1" and "A2" are hinged where attached to the plate and arm "A3" is hinged at both ends so that the bow/stem angle of the plate can be adjusted by varying the length of arm "A3."

Figure 2B:
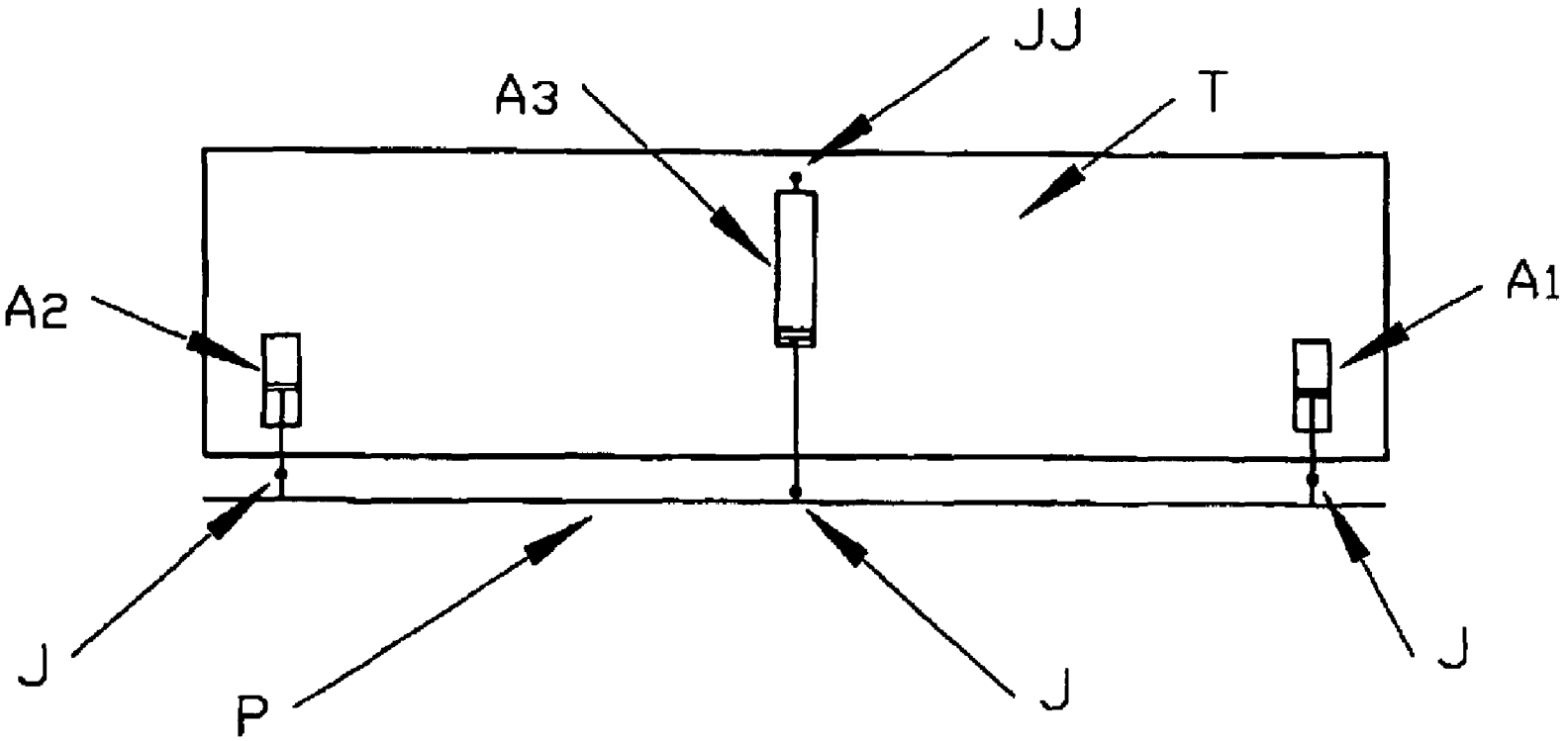

FIG. 2B is a stern view of the same configuration as FIG. 2A.

Figure 2C:
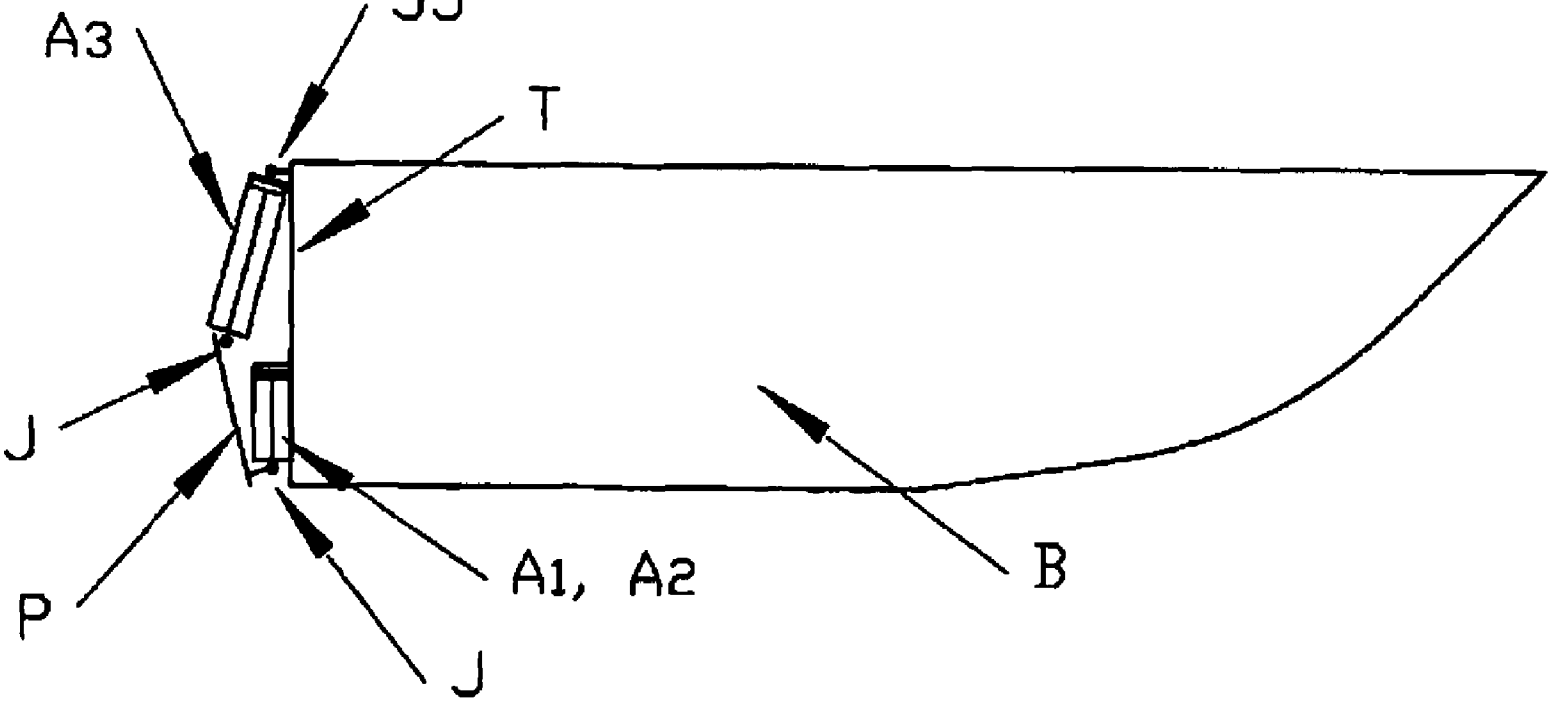

FIG. 2C is the same configuration as FIG. 2A with the plate in the closed/non-functioning position.

Figure 2D:
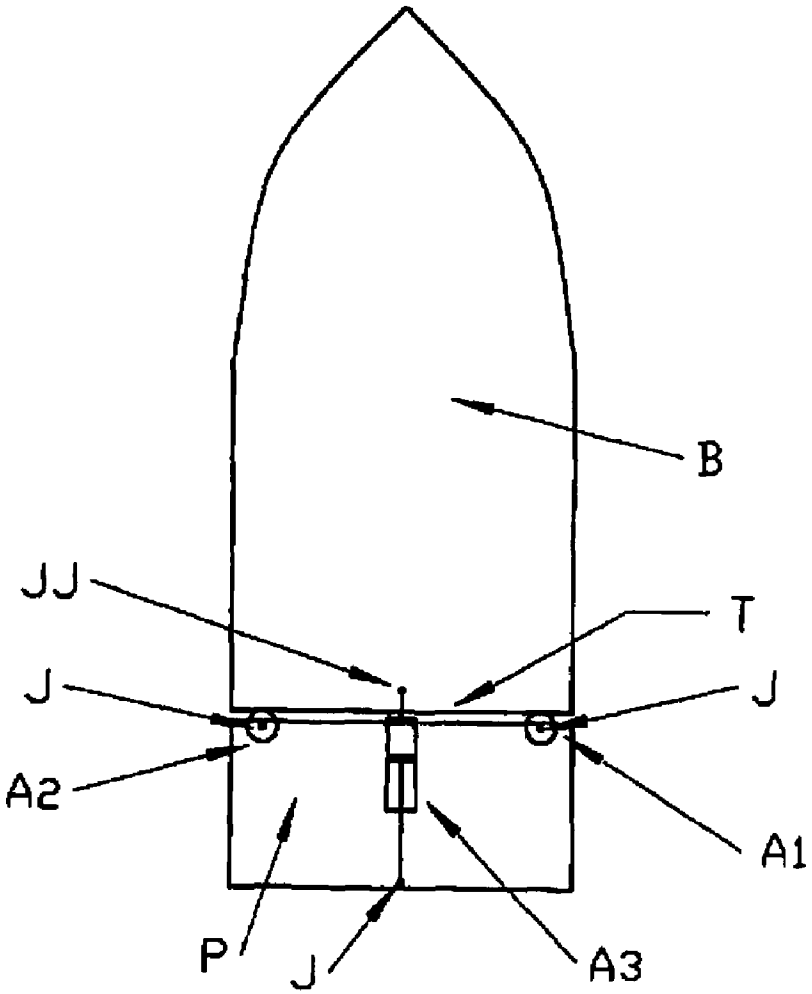

FIG. 2D is the top view of the same configuration as FIG. 2A.

Figure 3:
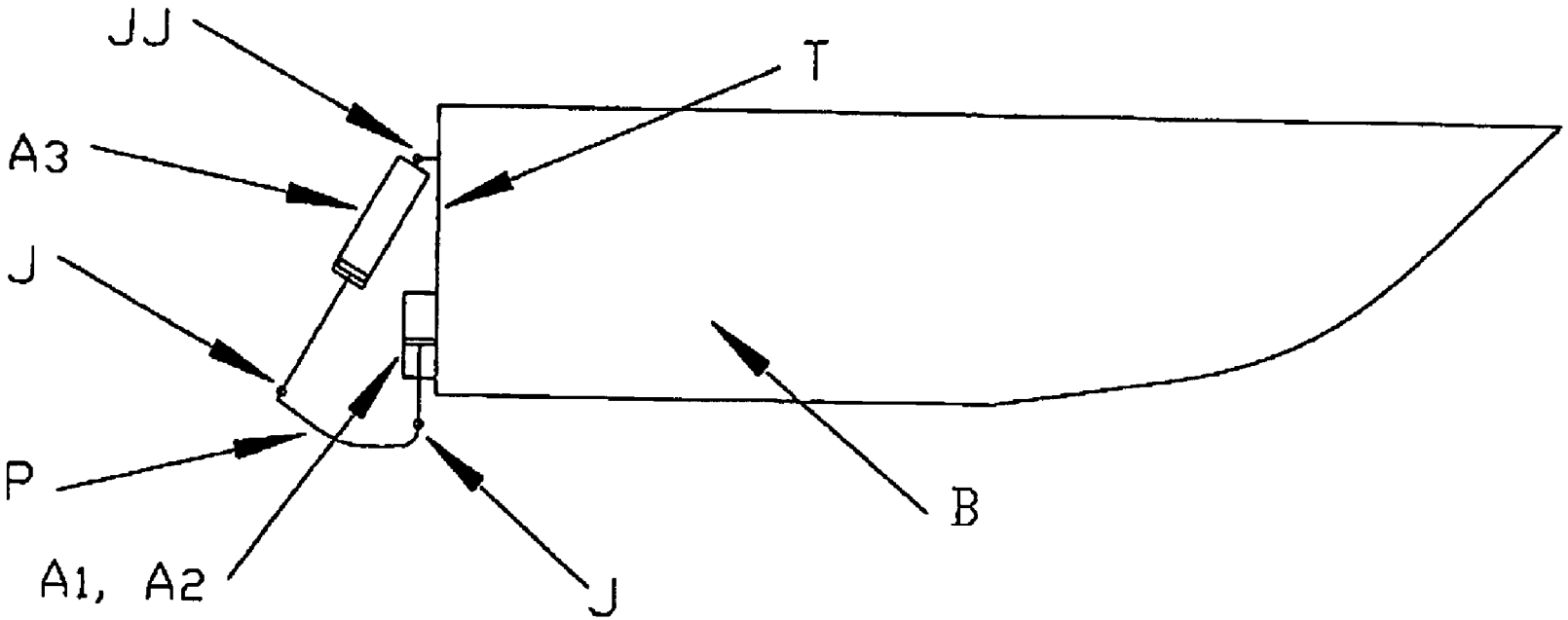

FIG. 3 is the same configuration as FIG. 2A except that the plate is curved upwards.

Figure 4:
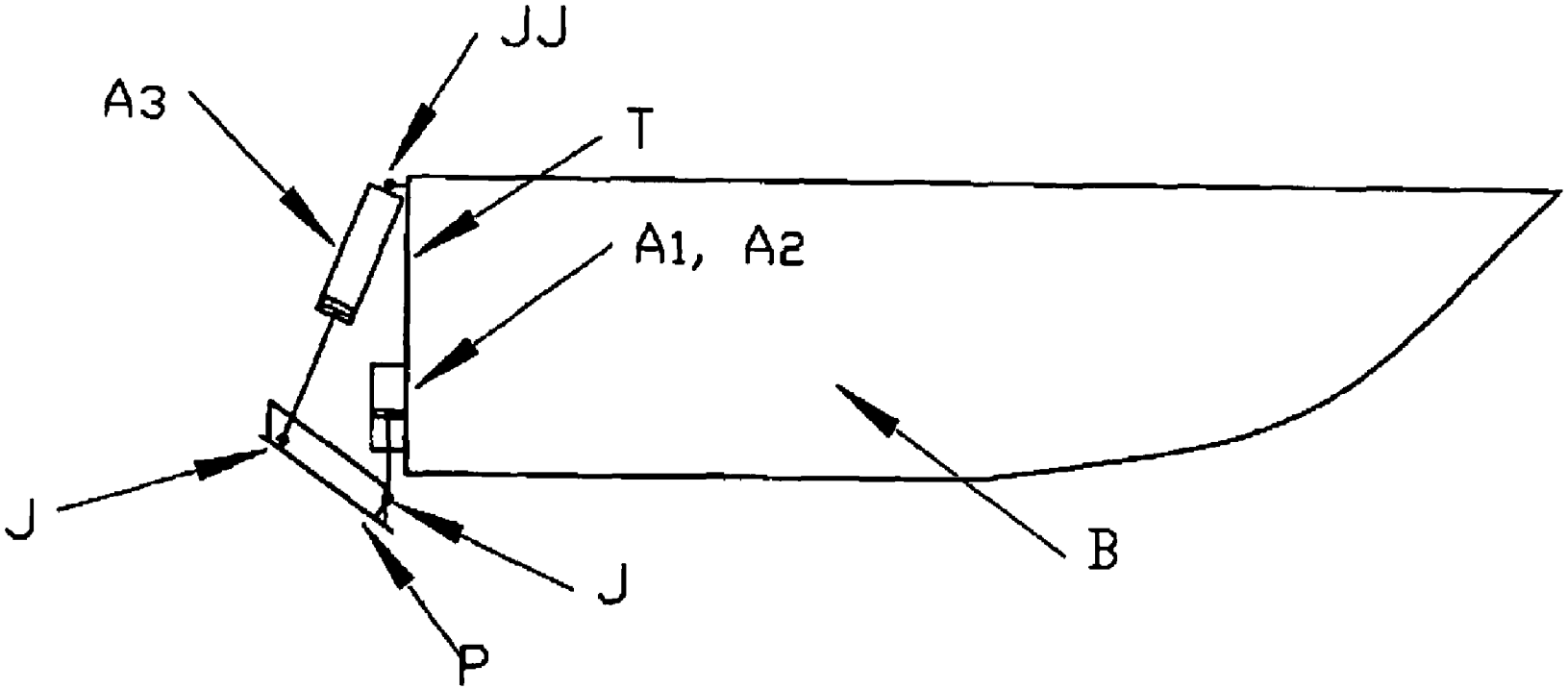

FIG. 4 is the same configuration as FIG. 2A except that the plate has side and back walls to hold the water that is scooped up by the plate.

Figure 5:
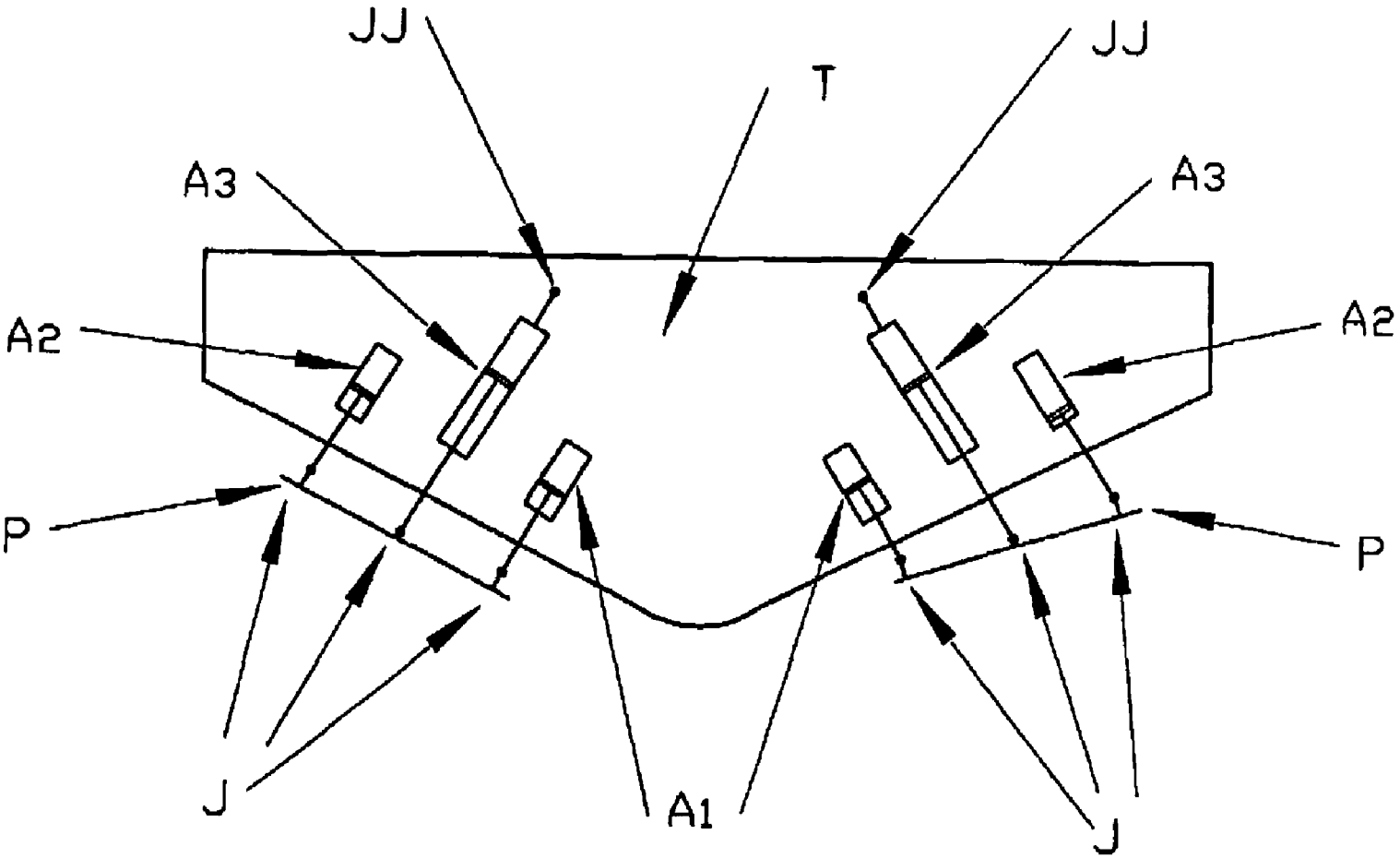

FIG. 5 is a stem view of a V-bottomed boat equipped with two wake control plates, which are shown, optionally, set at different tilt angles (by adjusting the same arms shown in FIG. 2A). This configuration works for boats with outboard motors or I.O. drives that occupy the middle area of the transom.

Figure 6A:
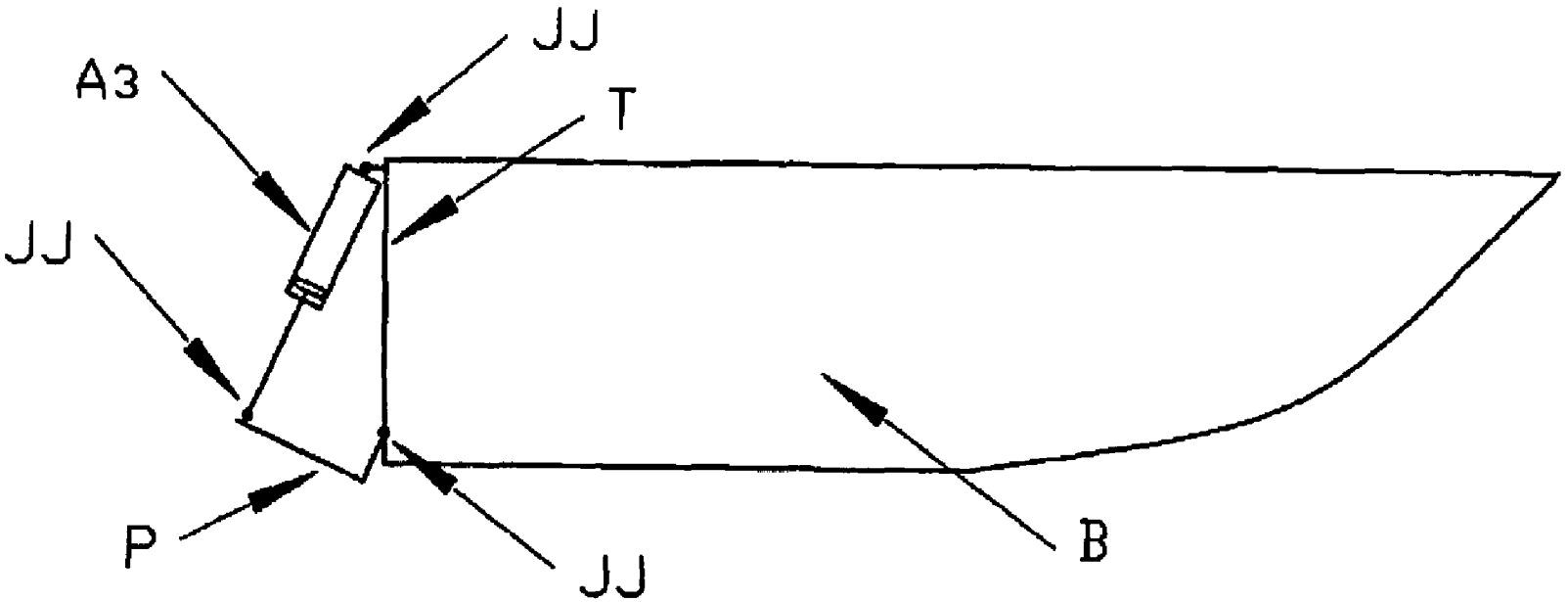

FIG. 6A is a side view showing a plate connected to the stem by nonadjustable arms at the front and one adjustable arm.

Figure 6B:
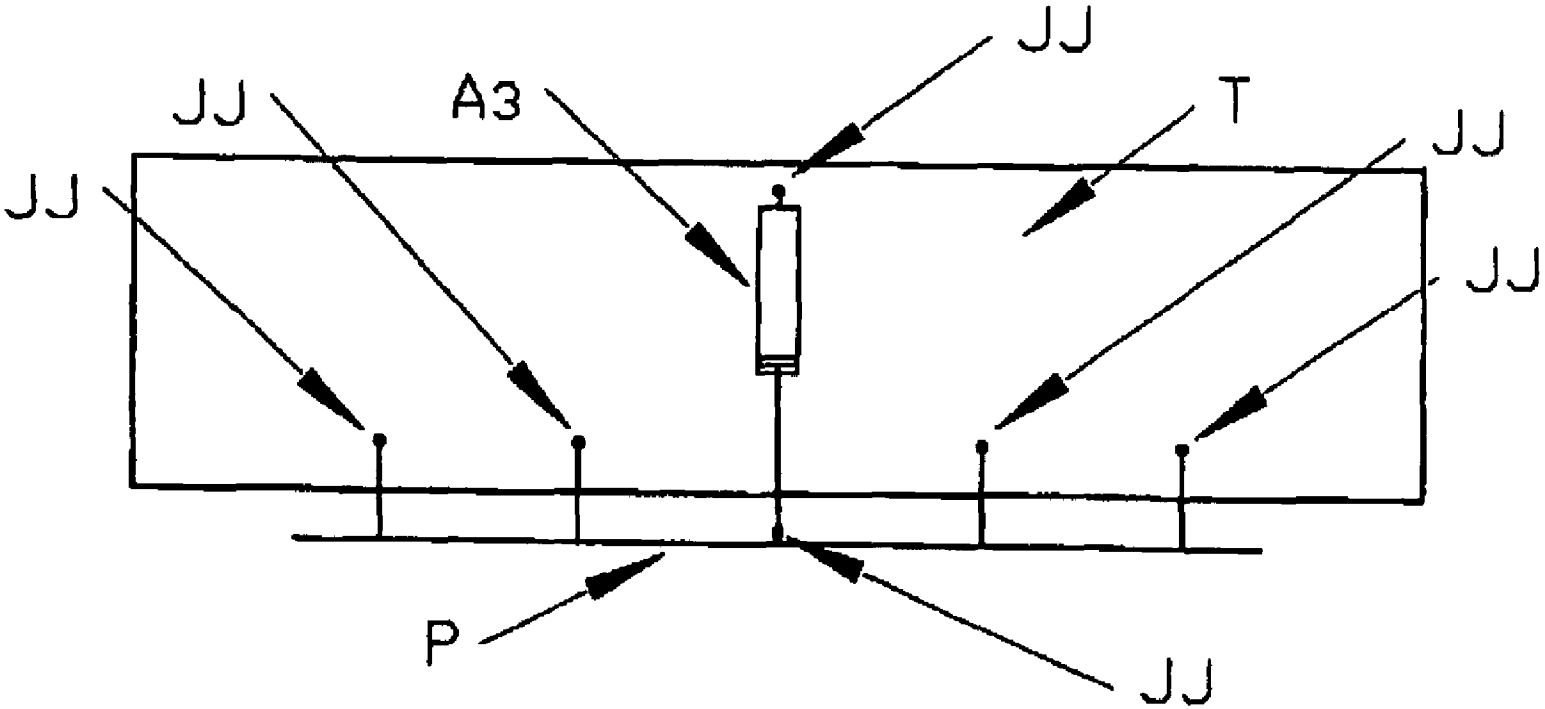

FIG. 6B is a stern view of the same configuration as FIG. 6A.

Figure 6C:
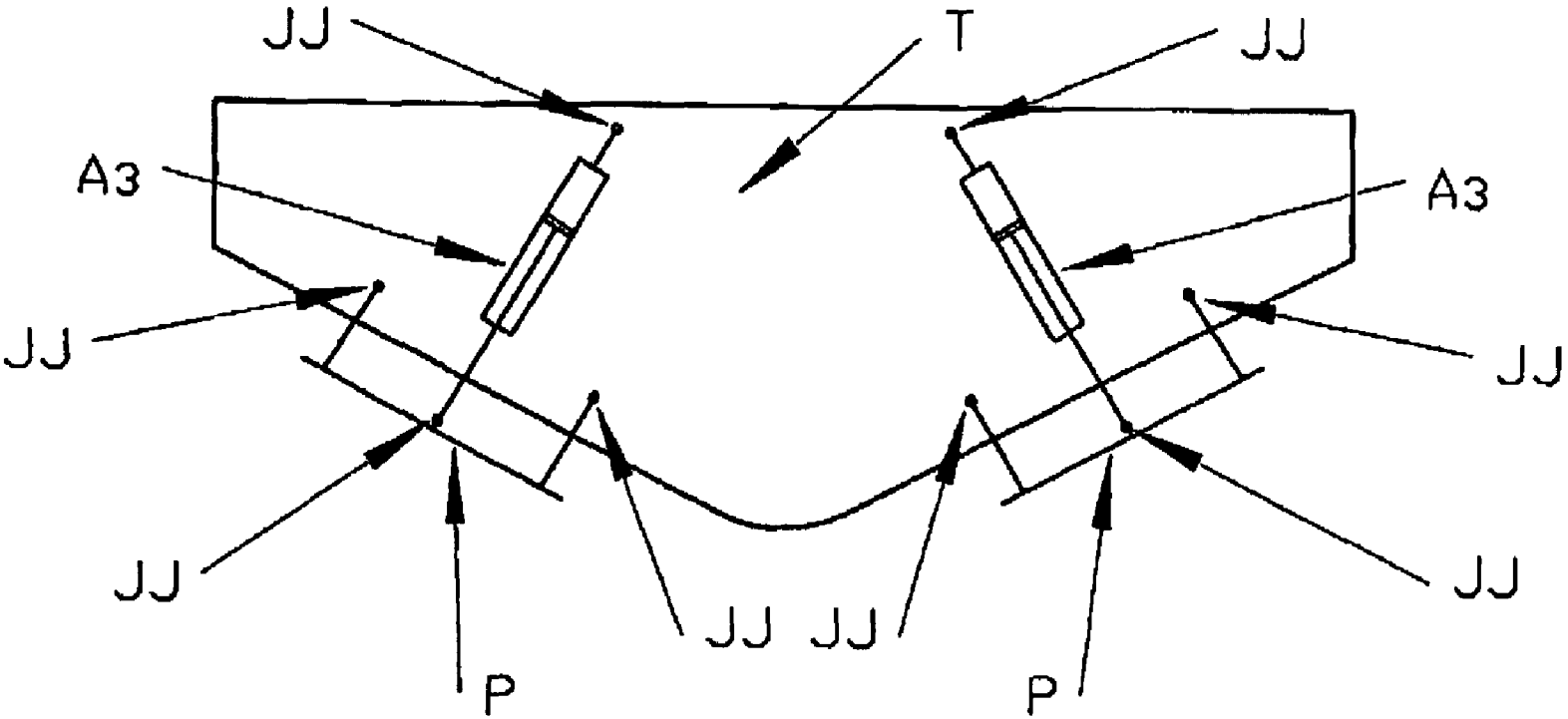

FIG. 6C is the same configuration as FIG. 6A except with two plates.

Figure 6D:
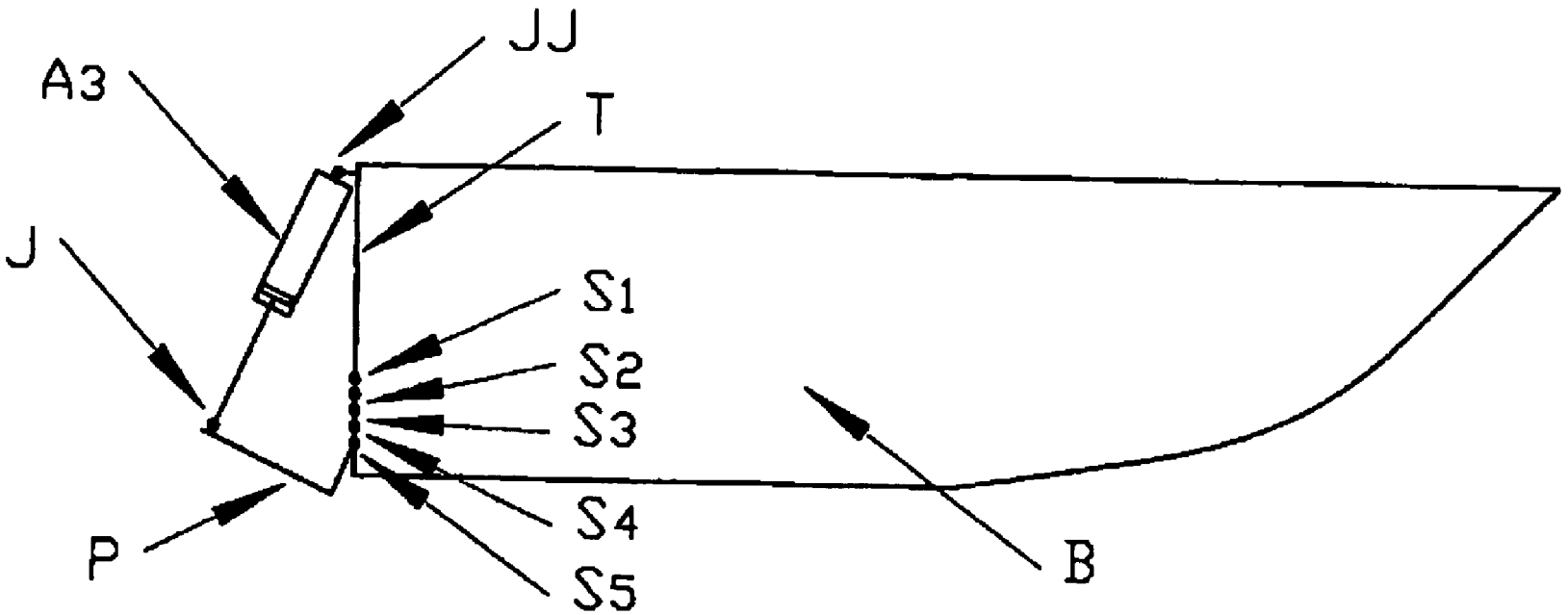

FIG. 6D is the same configuration as FIG. 6A, FIG. 6B and FIG. 6C except that the front joints may be attached, by hand, at different places on the transom. The top attachment location (S1) allows the plate to act as a normal trim tab because the front of the plate is flush with the bottom of the boat.

Figure 7:
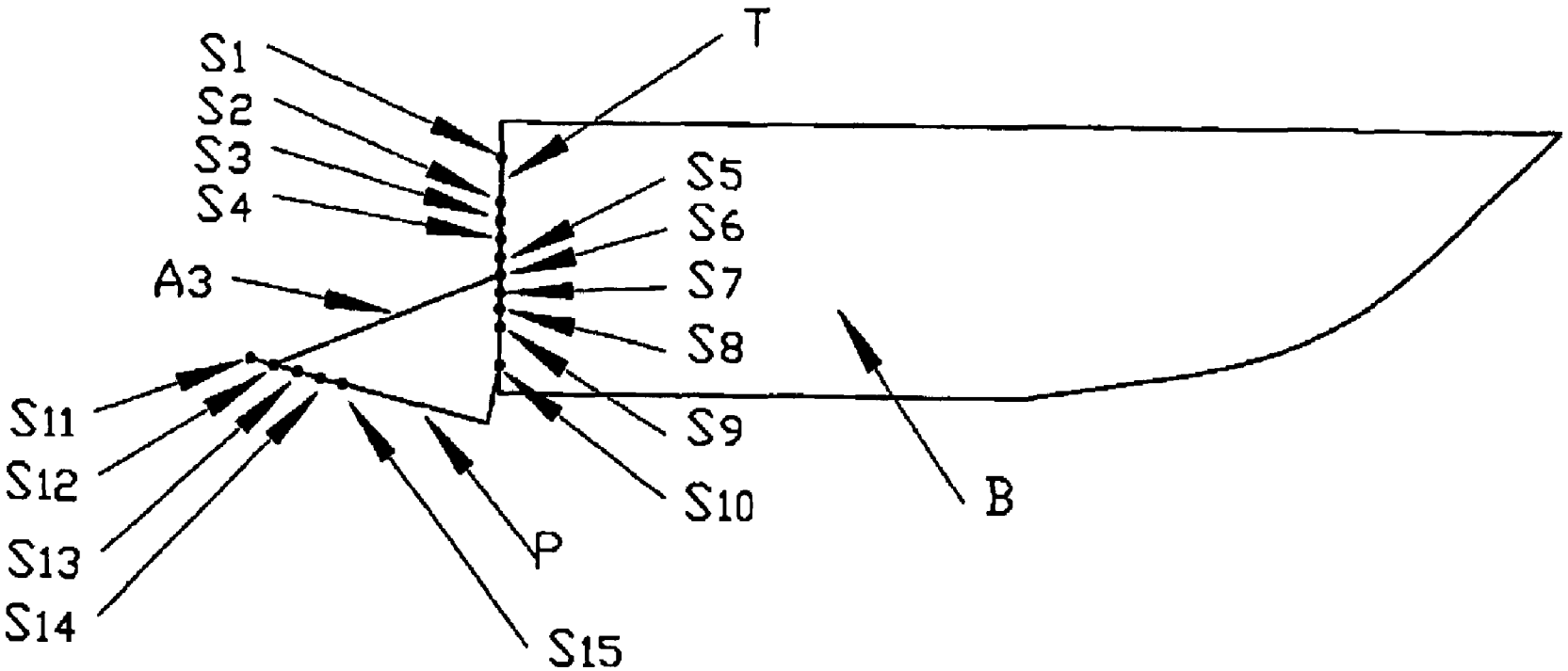

FIG. 7 shows a plate which has no motor powered adjustable arms. The plate is moved from the inactive/up position to the active/down position by manually changing the attachment points of arm "A3" and/or by adjusting the length of arm A3.

Figure 8:
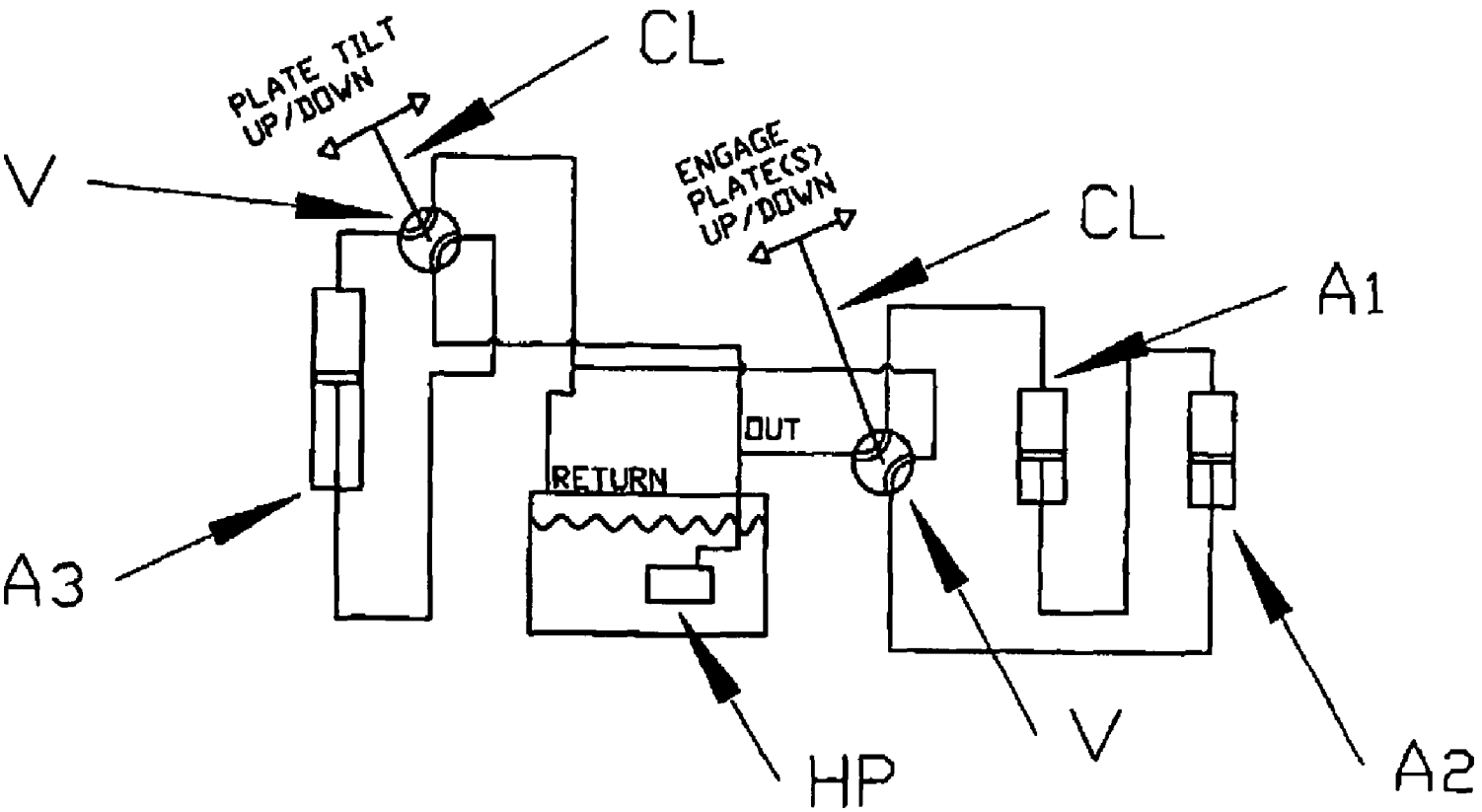

FIG. 8 shows one means of hydraulic control for adjusting the length of the arms. This configuration is when "A1" and "A2" remain equal to each other in length.

Figure 9:
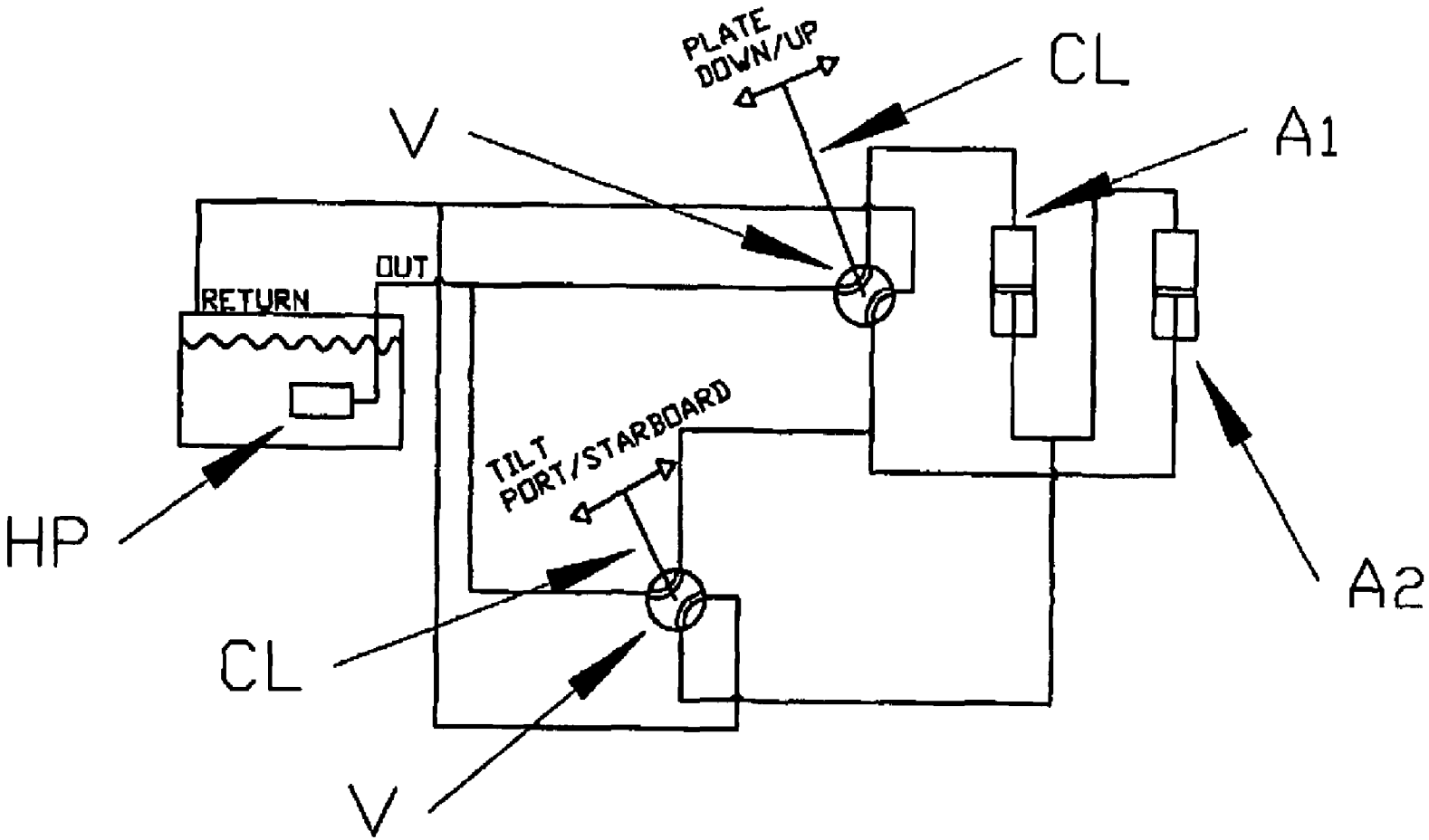

FIG. 9 shows a means of hydraulic control where in addition to moving the front of the plate up and down, the plate can be tilted sideways by adjusting "A1 " and "A2" to be different lengths.

DETAILED DESCRIPTION OF THE INVENTION

The preferred embodiment of the present invention is for boats that do not use an inboard-outboard or outboard engine and is depicted in FIG. 2A-FIG. 2D. The wake control plate "P" is connected to the transom "T" of the boat "B" by adjustable arms "A1", "A2" and "A3". Adjustable arms "A1" and "A2" are mounted rigidly on the Transom "T" and can only extend or contract vertically. "A1", "A2" and "A3" are connected to wake control plate "P" with a non-rigid joint "J", where a non-rigid joint is a connection that allows the arm 360 degrees of angular flexibility in one plane and up to approximately 20 degrees of angular flexibility in the direction perpendicular to that plane. (An example of a non-rigid joint that rotates 360 degrees in one direction and up to 20 in the other is the rubber gasket joint typically used on the bottom end of automobile shock absorbers). Non-rigid joints give the wake control plate the flexibility to tilt about any axis as the length of the adjustable arms are independently adjusted, although the front two arms "A1" and "A2" are typically adjusted in concert. Adjustable arm "A3" may be attached to the transom of the boat "T" by means of non-rigid or preferably rigid joint "JJ". In the preferred embodiment, the front edge of the plate, when in the active position, is about 5 cm below the transom and tilted about 20 degrees upward from the plane of the hull and, in the inactive position, the front of the plate is raised to be flush with the hull. In the inactive position the plate may be tilted down, thus acting like a normal trim tab to raise the back of the boat. (for boats with outboard motors or IO drives, two separate plates on either side of the drive, as shown in FIG. 5, or a single plate with a cutout may be used.)

Another embodiment or variation is to use a plate which has an upward curve as shown in FIG. 3. Just as a curved wing is more efficient at creating lift with less drag, a curved plate is more efficient at producing negative lift with less drag. Two disadvantages of this variation are the added expense of manufacture and the optimum amount of curvature varies with boat speed. Optionally, additional efficiency improvement is achieved by also varying the thickness of the curved or flat plate, just like a wing varies in thickness.

Another variation is to have a fixed distance that the plate extends below the bottom edge of the transom. This variation, shown in FIG. 6A-6C, is lower cost because "A1", "A2" and their associated control mechanisms are eliminated.

An even lower cost variation, as shown in FIG. 7, is a plate which is held in position by arms which are not adjustable during use. In FIG. 7, points "S1" through "S8" are positions where the arms can be snapped, hooked or screwed or otherwise connected to the transom. "S1" is the inactive position and "S2" through "S8" are the active positions with varying amounts of water scooping/deflection action. This configuration is expected to be more popular when retrofitting existing boats, where the cost of installing hydraulics and control-panel switches is greater than when factory-installed. For the configurations shown in FIG. 6-FIG. 7, the "fixed distance" that the plate extends below the hull is, of course, hand adjustable, for example by having different locations on a transom-plate where the hinges may be attached . . . including locations where the plate is flush with the hull bottom.

Arm "A3" may be connected anywhere on the plate, except along a line between "A1" and "A2", however somewhere between the middle and back edge provides the best combination of strength and lower manufacturing cost. Similarly arms "A1", "A2" and "A3" may be attached anywhere on or near the back of the boat, so long as the positions do not hinder movement of the plate. Also the plate(s) could be positioned so that part or all of the plate(s) is/are in front of the stern, either beneath or beside the transom.

FIG. 7 shows a plate which has no motor powered adjustable arms. The plate is moved from the inactive/up position to the active/down position by manually changing the attachment points of arm "A3" and/or adjusting the length of arm A3.

FIG. 4 is the same configuration as FIG. 2A except that the plate has side and back walls to hold the water that is scooped up by the plate.

FIG. 5 is a more expensive embodiment for boats with V or U shaped hulls and for boats equipped with outboard or inboard-outboard engines. However the implementation shown in FIG. 5 also works with boats driven by inboard motors and provides more flexibility in creating different wake effects than a single plate implementation.

For any configuration shown, plates may be curved in the sideways direction to match the V, U or other shape of the bottom of the transom. When more than one plate is used, the controls may allow for separate adjustment of each plate or one or more plates may be simultaneously adjusted by a single control mechanism or, for any number of plates, each arm may be independently adjustable. Substitutions of elements from one described embodiment to another and logical amendments and appendages to each embodiment are also fully contemplated. It is also to be understood that the drawings or the aspects of each drawing are not necessarily drawn to scale, but are used to visualize the concepts covered herein.

Embodiments may include:

A wake control mechanism for watercraft wherein the one or more wake control plates are attached to the stern of the watercraft by one or more length adjustable rods such that the plate's front edge can be positioned below the transom; are inclined to a set or controllable angle so as to scoop water upward, or are alternately set in the traditional trim tab position; are of any size; and are either flat or curved upward.

The wake control mechanism for watercraft as described above wherein the said one or more length adjustable rods connect to any location on or near the stern of the watercraft and any location on the said one or more wake control plates except in a straight line, so as to hold the said one or more wake control plates in the desired position.

The wake control mechanism for watercraft as described above wherein the said one or more length adjustable rods are adjusted hydraulically or through another power assistance.

The wake control mechanism for watercraft as described above wherein the said one or more length adjustable rods are adjusted manually.

The wake control mechanism for watercraft as described above wherein the said one or more wake control plates are curved to conform to the bottom of the said watercraft.

The wake control mechanism for watercraft as described above wherein the said one or more wake control plates are equipped with sides, or sides and a back side, enabling it to hold scooped up water.

The wake control mechanism for watercraft as described above wherein the said one or more wake control plates is incorporated with a bait tank, swim platform, ladder, motor mount or other function.

Embodiments may further include:

A wake control mechanism for watercraft wherein the one or more wake control plates are attached to the stern of the watercraft through one or more length adjustable rods and one or more connections with fixed lengths; are of any shape and size; can be positioned in the water by the said one or more length adjustable rods; can be submersed under the stern of the watercraft; and can be controlled independently or dependently from the other one or more wake control plates.

The wake control mechanism for watercraft as described above wherein the said one or more length adjustable rods connect to non-rigid joints on both the wake control plate and the stern of the watercraft, where a said non-rigid joint is a connection that allows the said length adjustable rods approximately 180 degrees of angular displacement in one plane and approximately 30 degrees of angular displacement in the direction perpendicular to that plane.

The wake control mechanism for watercraft as described above wherein the said one or more connections with fixed lengths attach to non-rigid joints on the wake control plate and rotating joints on the stern of the watercraft, where a said non-rigid joint is a connection that allows the said rods with fixed lengths approximately 180 degrees of angular displacement in one plane and approximately 30 degrees of angular displacement in the direction perpendicular to that plane and a said rotating joint is a connection which lets the said rods with fixed lengths rotate approximately 180 degrees about the connection.

The wake control mechanism for watercraft as described in above wherein the said one or more length adjustable rods and the said rods with fixed lengths connect to any location on the stern of the watercraft and said one or more wake control plates, such that the said one or more wake control plates are held in the desired position.

The wake control mechanism for watercraft as described above wherein the said one or more length adjustable rods are adjusted hydraulically or through another power assistance.

The wake control mechanism for watercraft as described above wherein the said one or more length adjustable rods are adjusted manually.

The wake control mechanism for watercraft as described above wherein the said one or more wake control plates are curved to conform to the bottom of the said watercraft.

The wake control mechanism for watercraft as described above wherein the said one or more wake control plates are equipped with side wells, or side and back walls enabling it to hold water.

The wake control mechanism for watercraft as described above wherein the said one or more wake control plates is incorporated with a bait tank, swim platform, ladder, motor mount or other function.

I claim:

1. A watercraft for controlling a size of a wake in a body of water, the watercraft comprising:

more than one arm pivotally coupled with the watercraft, comprising at least a first length adjustable arm;

a wake control plate coupled with the more than one arm; and a driver coupled with the first length adjustable arm to adjust a length of the first length adjustable arm to lower the wake control plate from an inactive position at which the wake control plate is out of the body of the water with a back edge of the wake control plate at a height above a height of a front edge of the wake control plate, to an active position at which the wake control plate is at least partially within the body of the water to scoop the water to produce a negative lift, wherein the negative lift lowers the stem of the watercraft further into the body of the water to adjust the size of the wake.

2. The watercraft of claim 1, wherein the more than one arm comprises a second length adjustable arm to adjust an angle of the wake control plate with respect to the stern of the watercraft.

3. The watercraft of claim 1, wherein the wake control plate comprises a plate having an upward curve between the front edge of the wake control plate and the back edge of the wake control plate.

4. The watercraft of claim 1, wherein the wake control plate comprises one or more walls adapted to accumulate the water to increase a magnitude of the negative lift.

5. The watercraft of claim 1, wherein the wake control plate comprises a swim platform.

* * * * *